US005697766A

United States Patent [19]

Oh

[11] Patent Number: 5,697,766

[45] Date of Patent: Dec. 16, 1997

[54] HERMETIC MOTOR COMPRESSOR SUCTION MUFFLER CONNECTION ASSEMBLY

[75] Inventor: Jae Seok Oh, Kyungsangnam-Do, Rep. of Korea

[73] Assignee: LG Electronics Inc., Rep. of Korea

[21] Appl. No.: 667,706

[22] Filed: Jun. 21, 1996

[30] Foreign Application Priority Data

Oct. 31, 1995 [KR] Rep. of Korea ..... 31581/1995

[51] Int. Cl.[6] ..... F04B 39/00

[52] U.S. Cl. ..... 417/312; 181/403

[58] Field of Search ..... 417/312, 902; 181/229, 403

[56] References Cited

U.S. PATENT DOCUMENTS 5,207,564 5/1993 Fritchman ..... 181/403

5,304,044 4/1994 Wada et al. ..... 417/312

5,577,898 11/1996 Lee ..... 417/312

*Primary Examiner*—Charles G. Freay

*Attorney, Agent, or Firm*—Ostrolenk, Faber, Gerb & Soffen, LLP

[57] ABSTRACT

A hermetic compressor suction muffler connection assembly is provided to facilitate the connection of a suction muffler to a cylinder head cover by means of transforming a side portion of the cylinder head cover. The cylinder head cover has an insertion recess formed thereof and a plurality of fixing recesses is formed a certain distance from each side of the insertion recess. A clamp has each end portion thereof fixed insertingly in a corresponding one of the plurality of fixing recesses and an extension extended from the clamp is inserted into the insertion recess. A plurality of fasteners connecting the cylinder head cover to a cylinder. A connecting member extended from a suction muffler is inserted into the insertion recess.

2 Claims, 4 Drawing Sheets

HERMETIC MOTOR COMPRESSOR SUCTION MUFFLER CONNECTION ASSEMBLY

BACKGROUND OF THE INVENTION

1. Field of the Invention

The present invention relates to a motor compressor muffler, and more particularly to a hermetic compressor suction muffler connection assembly capable of facilitating the connection of a suction muffler to a cylinder head cover by means of transforming a side portion of the cylinder head cover.

2. Description of the Conventional Art

As shown in FIGS. 1 through 3, a conventional hermetic motor compressor which is applied to a refrigerating system such as a refrigerator includes a suction pipe 2 formed on one side portion of a chamber 1, and a suction muffler 3 adjacent to the suction pipe 2 and installed in one side portion of a cylinder head cover 5 so as to minimize the noise or pulsations occurring when a refrigerant gas is being sucked into the suction pipe 2.

The cylinder head cover 5 is provided with an insertion hole 6 into which the suction muffler 3 is inserted, and connection holes 9 into which bolts 8 are screwed through a clamp 7.

The conventional hermetic motor compressor is also provided with an electric motor 11 and a rotor 12 formed respectively in a lower portion of the frame 10, a crank shaft 13 one end portion of which is connected to one side portion of the rotor 12, an eccentric member 14 connected to the other end portion of the crank shaft 8, a piston 16 which horizontally reciprocates in a cylinder 15 in accordance with the rotation of the eccentric member 14, an exhaust muffler 17 for reducing the noise or pulsations of the compressed refrigerant gas exhausted from the cylinder 15, and an exhaust pipe 19 connected to another side of the chamber 1 and discharging externally the refrigerant gas through a guide pipe 18 connected to the exhaust muffler 17

The operation of the conventional hermetic motor compressor as described above will be described.

First, when an electric power source fox performing a refrigerating cycle is powered on, the rotor 12 in the electric motor 11 rotates, thus to cause the crank shaft 13 connected thereto to rotate, and the vertical rotation force of the crank shaft 13 engages the eccentric member 14, so that the piston 16 connected to the eccentric member 14 reciprocates horizontally in the cylinder 15.

Then, the vacuum occurring due to the horizontal reciprocating movement of the piston 16 in the cylinder 15 causes the refrigerant gas to flow into the chamber 1 via the suction pipe 2, and the noise and pulsations during intake of the refrigerant gas are in the suction muffler 3 and is drawn into the cylinder 15.

The refrigerant gas is compressed by the piston 16 and is exhausted out of the cylinder 15. At this moment, the noise and pulsations during exhausting of the refrigerant gas are minimized in the exhaust muffler 17 and the refrigerant gas flows out through the exhaust pipe 19 connected to the guide pipe 18.

During the repeating of such operations, oil stored in a lower portion of the chamber 1 is passed through an oil passage formed lengthwise in the crank shaft 13 and dispersed at an upper portion of the crank shaft 13, thus to cool and lubricate the electric motor 11 and the compressor unit which generate high heat, and the refrigerant gas being exhausted from the exhaust pipe 19 plays a role in a cooling cycle.

The refrigerant gas in the above operation passes through the suction muffler 3, prior to the intake thereof into the cylinder 15.

Meanwhile, steel material has been preferred in the muffler manufacturing because of its low price and facilitation in its fabrication. However, such a steel material suction muffler has had a problem in which the volume expansion Of the heated refrigerant gas due to the heat occurring in the chamber during the operation results in a low efficiency in the compressor. By replacing the steel material with a plastic material, the refrigerant gas volume increase occurring due to heat could be prevented. However, whereas a steel material muffler can be easily connected to the cylinder head cover by such means as welding or screwing, a plastic material muffler has connection problems because of its peculiar property. Additionally, although there are known several connection methods in which a plurality of part members for connection are employed, cost increases as well as increased process steps have been inevitable under those methods.

SUMMARY OF THE INVENTION

Accordingly, it is an object of the present invention to provide a hermetic motor compressor suction muffler connection assembly capable of affixing a suction muffler by a simplified process into a cylinder head cover by transforming a side portion of the cylinder head cover so as to enable the suction muffler to be easily and simply connected to the cylinder head cover.

To achieve the above-described object, a hermetic motor compressor suction muffler connection assembly in accordance with the present invention is provided with a cylinder head cover having an insertion recess formed in a side portion of the cylinder head cover and a plurality of fixed recesses formed a certain distance from each side of the insertion recess, a clamp having each end portion thereof fixed insertingly in the plurality of fixed recesses and an extension extended from the clamp and inserted into the insertion recess, and a plurality of joint members for connecting to a cylinder the cylinder head cover, into which insertion recess a combining member extended from a suction muffler is inserted.

DETAILED DESCRIPTION OF THE PREFERRED EMBODIMENT

Figure 1:
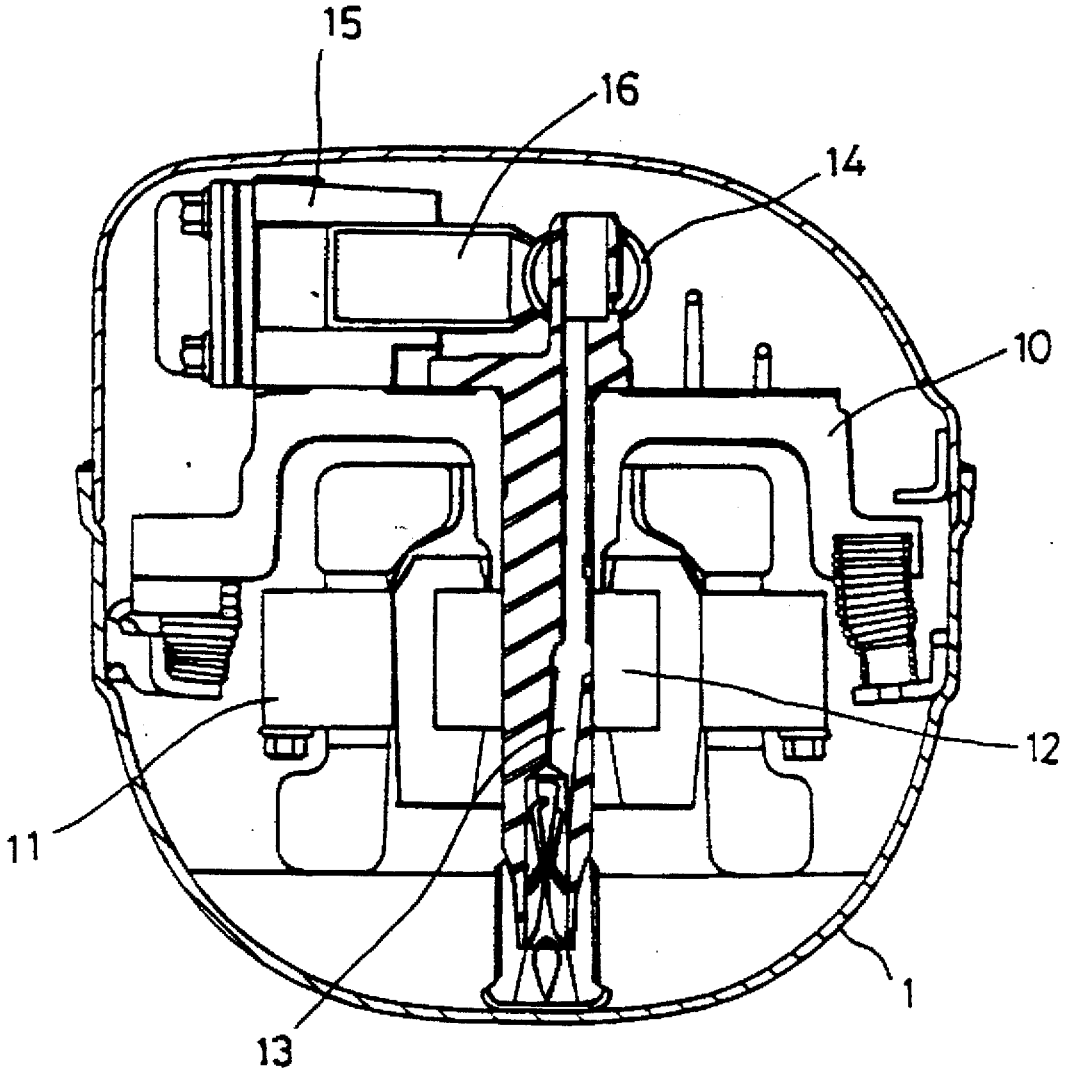
FIG. 1 CONVENTIONAL ART
FIG. 1 is a cross-sectional elevation view of a conventional hermetic motor compressor.
Figure 2:
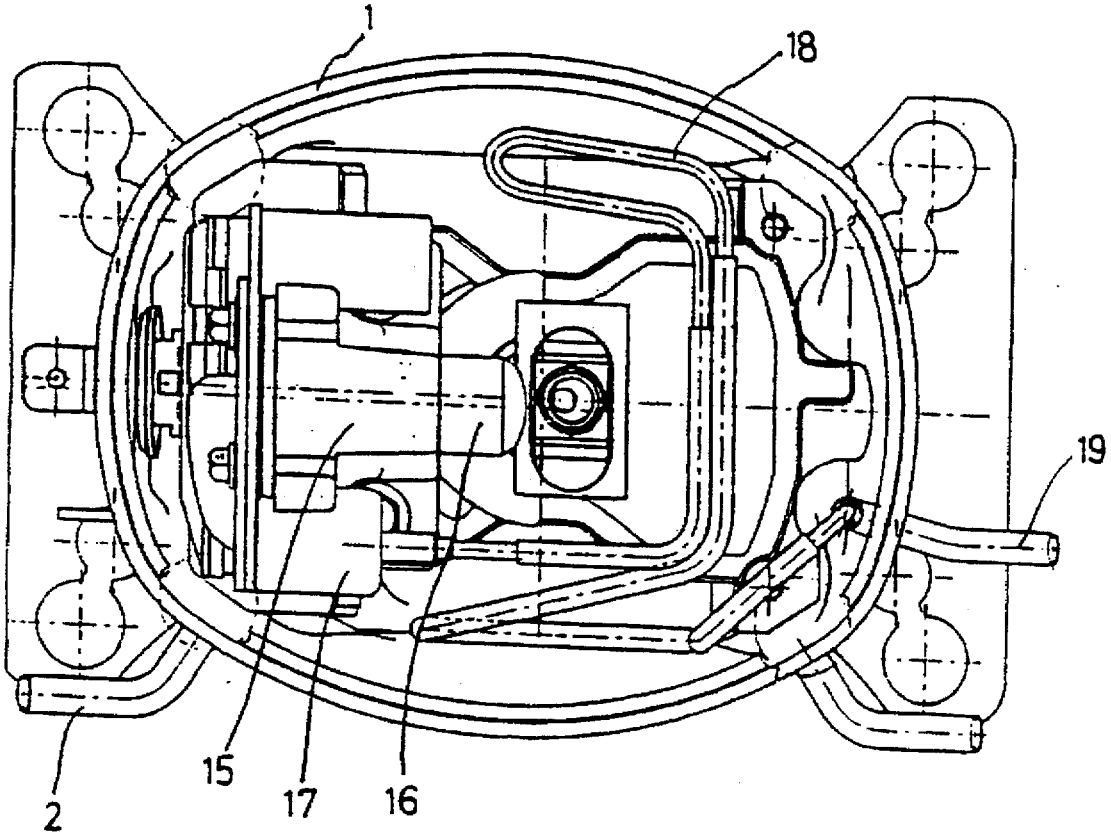
FIG. 2 CONVENTIONAL ART
FIG. 2 is a cross-sectional plan view of the conventional hermetic motor compressor.
Figure 3:
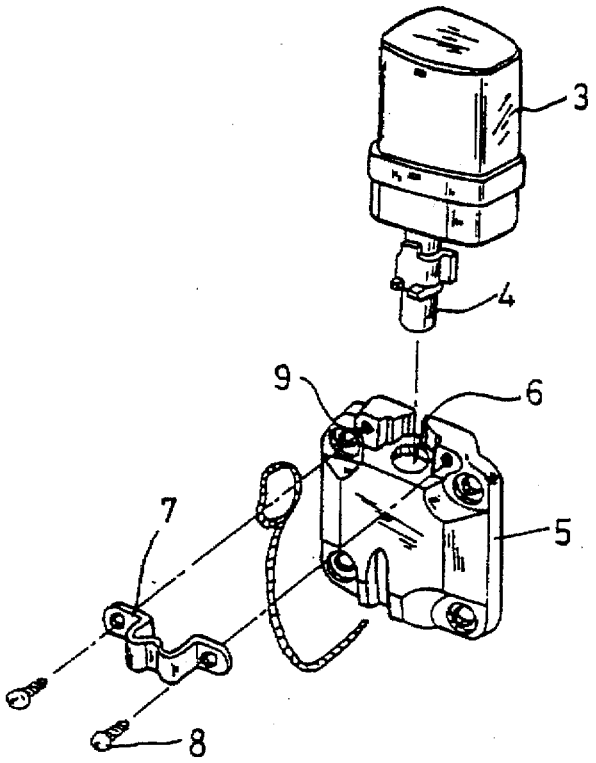
FIG. 3 CONVENTIONAL ART
FIG. 3 is an exploded perspective view showing a suction muffler being connected to a conventional cylinder head cover of a hermetic motor compressor.
Figure 4:
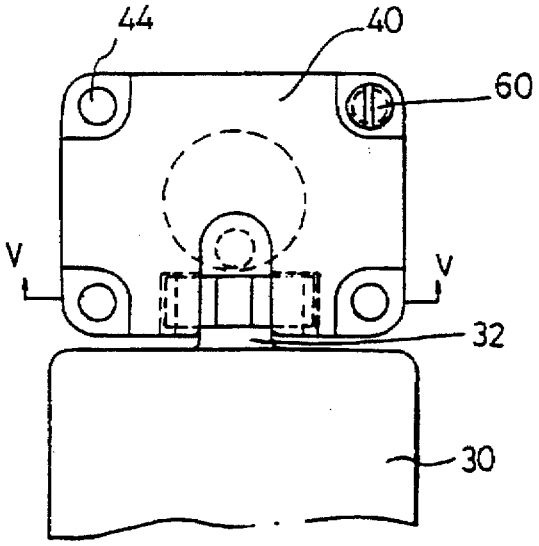
FIG. 4 is a cross-sectional view showing a hermetic motor compressor suction muffler connection assembly in accordance with the present invention.
Figure 5:
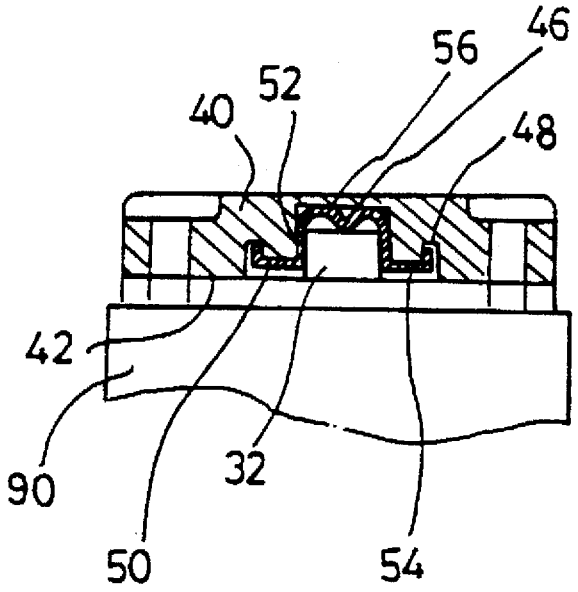
FIG. 5 is a cross-sectional view taken along the line V—V in FIG. 4.

As shown in FIGS. 4 and 5, an embodiment of a hermetic motor compressor suction muffler connection assembly in accordance with the present invention includes a cylinder head cover 40 which is provided with connection holes 44 in corner portions thereof. An insertion recess 46 is formed in one side portion of the cylinder head cover 40, and a plurality of fixing recesses 48 are formed symmetrically a certain distance from each side of the insertion recess 46. End portions of a clamp 50 are insertingly fixed in the fixing recesses 48, and an extension 52 thereof is tightly inserted into the insertion recess 46. A wave spring member 56 is formed at an upper portion of the extension 52, and a connecting member 32 is extended from a suction muffler 30 so that the connecting member 32 can be inserted inside the extension 52. In the state in which the connecting member 32 is inserted into the extension 52, the cylinder head cover 40 is fastened to a cylinder 90 by employing a plurality of fasteners 60 such as bolts. The wave spring member 56 elastically supports the connecting member 32 extended from the suction muffler 30 when the cylinder head cover 40 is fastened by the fasteners 60 to the cylinder 90.

With reference to the above-described composition, the operation and effect of the hermetic motor compressor suction muffler connection assembly in accordance with the present invention are as follows.

First, each end portion of the clamp 50 is insertingly fixed by the inner walls of the fixing recesses 48, and the extension 52 thereof is tightly inserted into the insertion recess 46. Then, the cylinder head (not shown) is mounted on an upper portion of the cylinder 90. The connecting member 32 extended from the suction muffler 30 is inserted inside the extension 52 of the clamp 50. The fasteners 60 are fastened into the connection holes 44 so as to connect the cylinder head cover 40 to the cylinder 90. At this moment, the wave spring member 56 of the clamp 50 elastically supports the connecting member 32 of the suction muffler 30 so that the suction muffler 30 is tightly fixed on the cylinder 90.

As described above, a hermetic motor compressor suction muffler connection apparatus in accordance with the present invention can sizably enhance the product reliability as well as the efficiency by providing much more simplified operation processes. An insertion recess and a pair of fixing recesses are formed in the cylinder head cover, and by inserting a clamp therein, a connecting member extended from the suction muffler is fixedly and simply fastened into the cylinder head cover.

What is claimed is:

1. A hermetic motor compressor suction muffler connection assembly comprising:

a cylinder head cover having an insertion recess formed in a side portion thereof and a plurality of fixing recesses formed a certain distance from each side of the insertion recess;

a clamp having each end portion thereof fixed insertingly in a corresponding one of the plurality of fixing recesses, and an extension extended from said clamp and inserted into said insertion recess; and a plurality of fasteners fox connecting said cylinder head cover to a cylinder, into said insert recess a connecting combining member extended from a suction muffler being inserted into said insertion recess.

2. The hermetic motor compressor suction muffler connection assembly of claim 1, wherein said extension includes a plurality of wave spring members so as to elastically support said connecting member.

* * * * *